US010100624B2

(12) United States Patent
Jamieson et al.

(10) Patent No.: US 10,100,624 B2
(45) Date of Patent: Oct. 16, 2018

(54) BOTTOM DISCHARGE ELECTRIC SUBMERSIBLE PUMP SYSTEM AND METHOD

(71) Applicant: Schlumberger Technology Corporation, Sugar Land, TX (US)

(72) Inventors: Euan Jamieson, Inverurie (GB); Stuart Irvine, Inverurie (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 461 days.

(21) Appl. No.: 14/655,497

(22) PCT Filed: Dec. 31, 2013

(86) PCT No.: PCT/US2013/078567

§ 371 (c)(1),
(2) Date: Jun. 25, 2015

(87) PCT Pub. No.: WO2014/107472

PCT Pub. Date: Jul. 10, 2014

(65) Prior Publication Data

US 2015/0354331 A1 Dec. 10, 2015

Related U.S. Application Data

(60) Provisional application No. 61/748,392, filed on Jan. 2, 2013.

(51) Int. Cl.

| | |
|---|---|
| ***E21B 43/12*** | (2006.01) |
| ***E21B 43/40*** | (2006.01) |
| ***E21B 43/16*** | (2006.01) |

(52) U.S. Cl.
CPC ..... *E21B 43/16* (2013.01); *E21B 43/128* (2013.01)

(58) Field of Classification Search
CPC ..... E21B 43/12; E21B 43/128; E21B 43/385; E21B 43/40

(Continued)

(56) References Cited

U.S. PATENT DOCUMENTS 4,805,697 A * 2/1989 Fouillout ..... E21B 43/385 166/265
5,979,559 A * 11/1999 Kennedy ..... E21B 43/121 166/106

(Continued)

OTHER PUBLICATIONS

Shinaiber, et al, "Successful Offshore Deployment of the First Bottom Discharge ESP in Saudi Aramco," SPE 142526, (2011) 13 pages.

*Primary Examiner* — Kenneth L Thompson

(57) ABSTRACT

A bottom discharge ESP is disposed within a pod casing. The pod casing is adapted to connect to and support the weight of downstream tailpipe tubing sections so the ESP does not have to support the same. The ESP may be suspended within the pod interior space by a supporting tube disposed above the ESP and extending into the pod interior space. The ESP includes a discharge tube with a seal assembly that engages a seal bore formed in the bottom end of the pod and cooperating with an interior surface of the tailpipe tubing to convey pumped injection fluid downward to the tailpipe tubing. Part of the pod casing may be perforated to allow injection fluid to flow into the pod interior space. Alternatively, perforated tubing joints or sliding sleeves may be provided on an upper tube to permit flow of injection fluid to the interior of the pod.

9 Claims, 4 Drawing Sheets

(58) Field of Classification Search
USPC ..... 166/65.1, 66.4, 68, 105
See application file for complete search history.

(56) References Cited

U.S. PATENT DOCUMENTS

| | | | | |
|---|---|---|---|---|
| 6,056,511 | A * | 5/2000 | Kennedy | E21B 43/121 417/423.3 |
| 6,167,965 | B1 * | 1/2001 | Bearden | E21B 43/121 166/105.5 |
| 6,325,143 | B1 * | 12/2001 | Scarsdale | E21B 43/128 166/106 |
| 6,568,475 | B1 * | 5/2003 | Grubb | E21B 27/02 166/305.1 |
| 7,635,030 | B2 * | 12/2009 | Knight | E21B 43/128 166/106 |
| 8,448,699 | B2 | 5/2013 | Camilleri et al. | |
| 8,485,797 | B2 * | 7/2013 | Martinez | E21B 43/128 310/87 |
| 9,103,199 | B2 * | 8/2015 | Lannom | E21B 27/02 |
| 9,708,895 | B2 * | 7/2017 | Bassett | E21B 43/162 |
| 2003/0127223 | A1 * | 7/2003 | Branstetter | E21B 47/10 166/250.15 |
| 2004/0251019 | A1 * | 12/2004 | Howell | E21B 43/128 166/105.5 |
| 2006/0245957 | A1 | 11/2006 | Berry et al. | |
| 2010/0108307 | A1 * | 5/2010 | Brown | E21B 43/124 166/105.5 |
| 2010/0122818 | A1 | 5/2010 | Rooks | |
| 2010/0258306 | A1 * | 10/2010 | Camilleri | E21B 43/128 166/265 |

* cited by examiner

BOTTOM DISCHARGE ELECTRIC SUBMERSIBLE PUMP SYSTEM AND METHOD

CROSS-REFERENCE TO RELATED APPLICATION

The present document is based on and claims priority to U.S. Provisional Patent Application Ser. No. 61/748,392, filed Jan. 2, 2013, the entire subject matter of which is incorporated herein by reference.

BACKGROUND

Oil well completions may employ electric submersible pumps (ESP's) to inject fluid from a source zone to a target zone. In some applications, such as artificial lift applications, the target zone is above the source zone and the ESP is configured to pump production fluid upward. In other applications, such as dump flood applications, the target zone may be located downhole from the source zone and the ESP is configured to pump injection fluid downward.

ESP applications in which the target zone is located downhole from the source zone may require very long tubing strings to convey the fluid from the ESP to the downhole target zone. Moreover, such applications may also require high fluid flow rates and thus relatively large tubing diameters. These requirements mean that the downhole tubing configurations can have very high weights and thus exert very high forces on structures that support the tubing. Thus, a challenging problem associated with such ESP applications is to provide safe and dependable support for the downstream tubing while meeting other operational requirements in a given well completion.

One known approach to address the aforementioned problem is to utilize a conventional ESP, oriented to discharge fluid upward, and a Y-tool or bypass system at the ESP discharge to reverse fluid flow. The flow is conveyed from the ESP discharge through the Y-tool and in a downhole direction to tailpipe tubing. While such solutions do address the problem of tensile capacity and supporting the heavy weight of the downstream tubing, they still have drawbacks. One drawback is that the bypass system or Y-tool may have limited tensile strength and therefore limited ability to support the weight of the downhole tubing to which it is connected. Another drawback is that conventional bypass systems or Y-tools are impractical for high flow rate applications since the bypass tubing and ESP must be positioned side-by-side within the wellbore, and thus the diameter and flow rate of the bypass system are necessarily limited.

Other solutions for ESP applications in which the target zone is below or downhole from the source zone may employ an ESP configured for bottom discharge, as is described, for example, in SPE142526 or in the document at http://www.slb.com/resources/technical_papers/artificial_lift/142526.aspx. Bottom discharge ESP's have the advantage of eliminating the need for flow reversal systems, such as Y-tools. However, support of the downstream tubing strings using the ESP structure is not practical because the ESP system is typically not designed with such support in mind and generally has poor tensile capacity.

Recently, pod systems have been recognized as providing advantages in ESP applications. Such pod systems are described in the above-referenced provisional application (FIG. 1) and in U.S. Pat. No. 8,448,699, assigned to Schlumberger Technology Corporation, the subject matter of which is incorporated herein by reference in its entirety.

SUMMARY

Aspects of the present invention provide techniques for addressing the aforementioned problems and shortcomings. According to one aspect, the techniques utilize a bottom discharge ESP disposed within an interior space of a pod casing. The pod casing is adapted to connect to and support the weight of the downstream tailpipe tubing sections, transferring tensile forces to components above the ESP. The ESP may be suspended within the pod interior space by a supporting tube disposed above the ESP and extending into the pod interior space. The ESP includes a discharge tube with a seal assembly that engages a seal bore formed in the bottom end of the pod and cooperating with an interior surface of the tailpipe tubing to convey pumped injection fluid downward to the tailpipe tubing. The weight of the tailpipe tubing string is thus borne by the pod casing rather than the ESP.

Part of the pod casing may be perforated to allow injection fluid to flow from outside the pod, i.e., from the well casing, into the pod interior space and to the ESP pump inlet. The injection fluid may flow through tubing disposed above the pod and into the pod interior, through the annulus formed between the pod and well casing, or both. Injection fluid then flows to the ESP intake and is discharged in a downhole direction into the tailpipe tubing.

Another aspect of the invention provides an alternative configuration in which one or more perforated tubing joints in tubing above the ESP permit the flow of injection fluid from the well casing into the pod interior space. An upper perforated joint in an upper tube may be provided above the pod, permitting fluid to flow from the well casing to the interior of the upper tube to a lower perforated joint disposed within the pod interior space to permit flow of injection fluid into the interior space.

According to yet another aspect, one or more sliding sleeves may be used to replace the perforated tubing joints to provide for communication of injection fluid from the well casing to the pod interior space. The sliding sleeves may be used to control the flow of injection fluid into the pod interior space and to the ESP.

According to yet another aspect, a method for injecting fluids from a source zone to a downhole target zone associated with a well, comprising providing a pod having a pod casing that defines an interior space. Also included in this method is providing an electric submersible pump supported within the pod casing interior space and having an inlet. Further method steps include providing a flow path for conveying fluid from the source zone to the electric submersible pump inlet and providing a tailpipe having one or more tubing sections extending in a downhole direction and being cooperatively associated with the pod such that the weight of the tailpipe is substantially supported by the pod.

BRIEF DESCRIPTION OF THE DRAWINGS

Certain embodiments of the invention will hereafter be described with reference to the accompanying drawings, in which like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described aspects may be possible.

Figure 1:
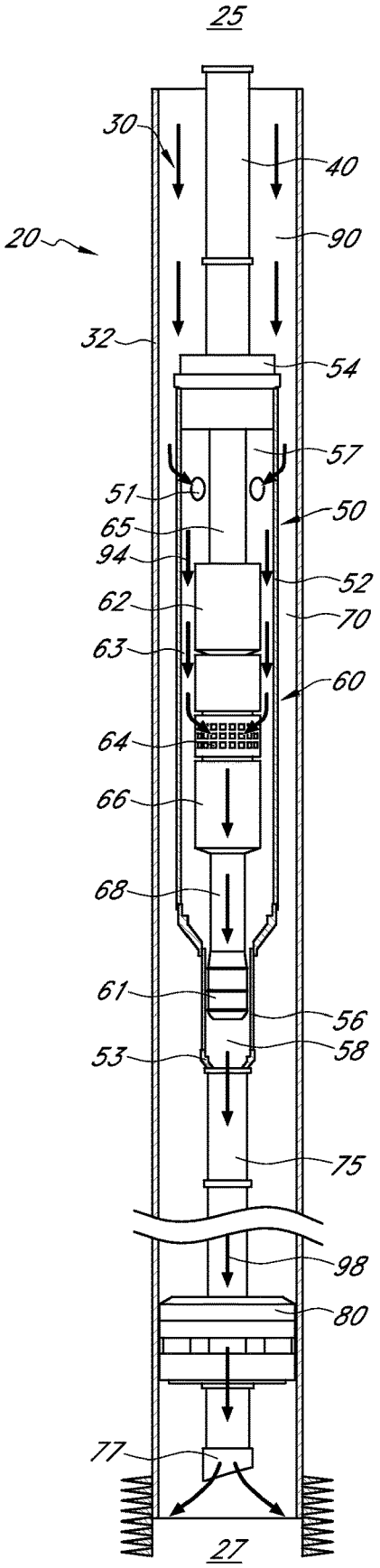
FIG. 1 is a front elevation view of an exemplary bottom discharge ESP system that incorporates a perforated pod casing according to an aspect of the invention.

Referring generally to FIG. 1, which is a front elevation view, an exemplary bottom discharge ESP system 20 according to aspects of the invention may be disposed in a well 30 which may include a well casing 32. Injection fluids are generally conveyed from a source zone 25 to a downhole target zone 27. An upper tubing section 40 may support downhole components, including a pod 50, which encloses an ESP 60 and defines a pod/well casing annular space 70 with the well casing 32.

Pod 50 includes a generally cylindrical outer pod casing 52, which is supported by a pod cap or hanger 54 through a threaded connection or other implement for providing large tensile capacity. Pod 50 extends downward and tapers to a pod lower end 56, the size of which may correspond to the dimensions of downstream tailpipe tubing sections 75. Pod casing 52 defines an interior space 57, which houses ESP 60. According to an aspect of the invention, pod casing 52 may include one or more perforations 51 for permitting flow of injection fluids from the exterior of pod 50 (i.e., from interior of well casing 32) into the interior space 57 of pod 50. A seal bore 58 may be defined in the pod lower end 56 to receive a seal assembly 61 provided near a bottom end of a discharge tube 68 of ESP 60, as will be described in more detail below. The pod lower end 56 may interface with an uppermost one of the tailpipe tubing sections 75 via a pod lower end/tailpipe interface, which may include a crossover connection 53. As will be recognized, the pod lower end/tailpipe interface connection 53 may be any suitable connection that provides large tensile capacity sufficient to support the collective weight of the tailpipe tubing sections 75 and safely transfer such forces to the pod casing 52.

ESP 60 includes an ESP motor 62, inlet 64 and pump 66 discharge tube 68. According to an aspect of the invention, the ESP may be suspended within the pod 50 from above by supporting tube 65 and may have a lower discharge tube 68 which engages, via a seal assembly 61, a seal bore 58 defined in the pod lower end 56. The seal assembly 61 provides isolation between the ESP inlet 64 and the lower end or outlet of pump discharge tube 68. It will be recognized that other isolation devices may be used in place of the seal assembly 61, such as a packer (not shown). As will be recognized, the supporting tube 65 bears the weight of the ESP 60 and supports it in a suspended manner within the pod 50, while the lower end of discharge tube 68 is sealingly engaged with the seal bore 58 of pod 50. It will also be recognized that ESP be may be supported in other ways in which the ESP is isolated from or does not bear significant portions of the weight of the downstream tubing sections 75.

The tailpipe tubing sections 75 may extend downward through an isolation device, such as a packer 80, which isolates the target zone 27 and tailpipe tubing section discharge end 77 from the source zone 25 and other components above packer 80.

Source fluid may flow on an upper flow path 90 from the source zone 25 into the interior of well casing 32 via an upper annular space defined by the outer surface of the upper tubing section 40 and the well casing 32, and into the pod interior space 57 via perforations 51. Injection fluid may then flow via flow path 94 into the annular space 63, defined by the ESP outer dimensions and the interior wall of pod casing 52, to the ESP inlet 64. Injection fluid is then pumped through the bottom discharge ESP to tailpipe tubing sections 75 via flow path 98 and ultimately to the target zone 27.

Figure 2:
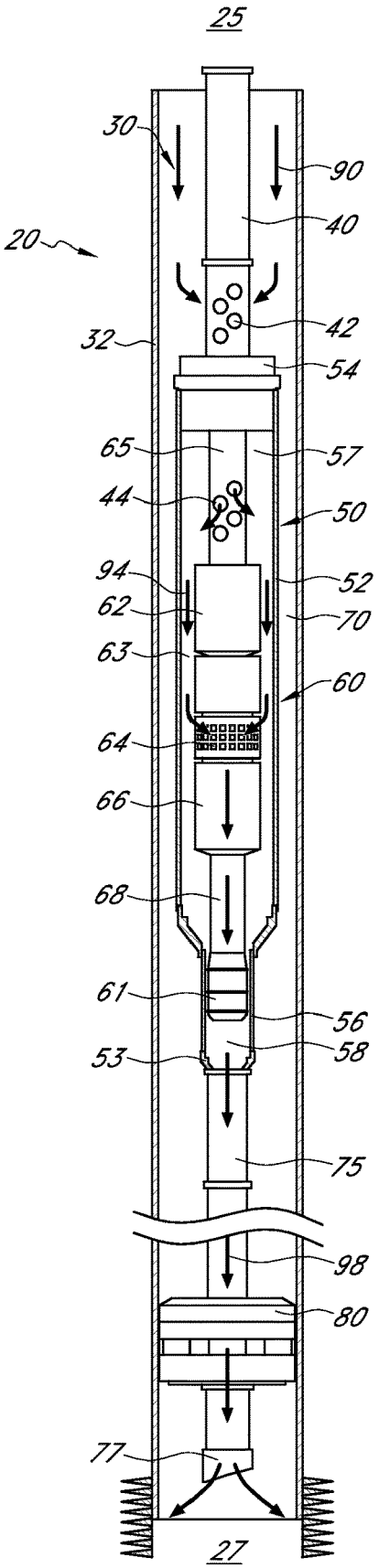
FIG. 2: is a front elevation view of an exemplary bottom discharge ESP system that incorporates perforated tubing joints above the ESP (within pod), and above the pod according to an aspect of the invention.

An implementation according to another aspect of the invention is illustrated in FIG. 2, which is a front elevation view. Upper tubing section 40 may be provided with an upper perforated joint 42, to permit flow of fluid from the source zone 25 to the interior of the upper tubing section 40, and lower perforated joint 44 provided on or as part of supporting tube 65, to permit flow of fluid into the interior space of pod 57. Flow then continues in the manner described above with regard to FIG. 1.

Figure 3:
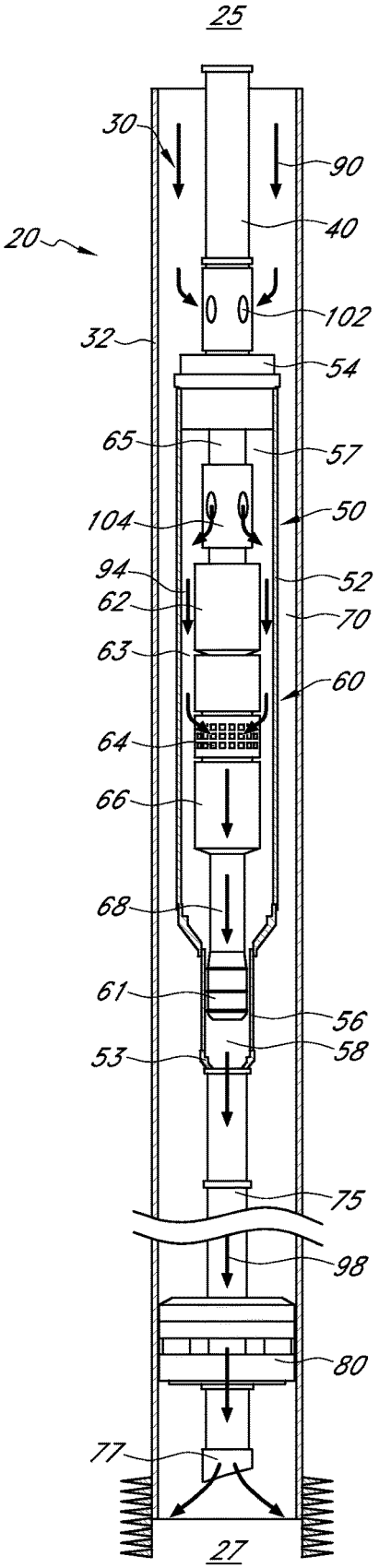
FIG. 3 is a front elevation view of an exemplary bottom discharge ESP system that incorporates a sliding sleeve above the ESP (within the pod) in place of the perforated tubing joint of FIG. 2, according to an aspect of the invention; and, FIG. 4 is a flow chart of an exemplary method associated with a bottom discharge ESP system that incorporates a perforated pod casing according to an aspect of the invention.

FIG. 3 illustrates another implementation of a bottom discharge ESP within a pod 50 according to another aspect of the invention. In this implementation, traditional sliding sleeves 102 and 104 may be used in place of the perforated joints 42 and 44. Sliding sleeves 102 and 104 may be used to permit and control flow of injection fluids to the interior space 57 of pod 50. Sliding sleeves 102 and 104 may be operated mechanically with appropriate downhole actuators, or from the surface with a control line. Once inside the interior space 57, flow of injection fluid continues as described above with regard to FIGS. 1 and 2. It will be recognized that other flow control devices may be employed in place of sliding sleeves, such as surface controlled valves.

Figure 4:
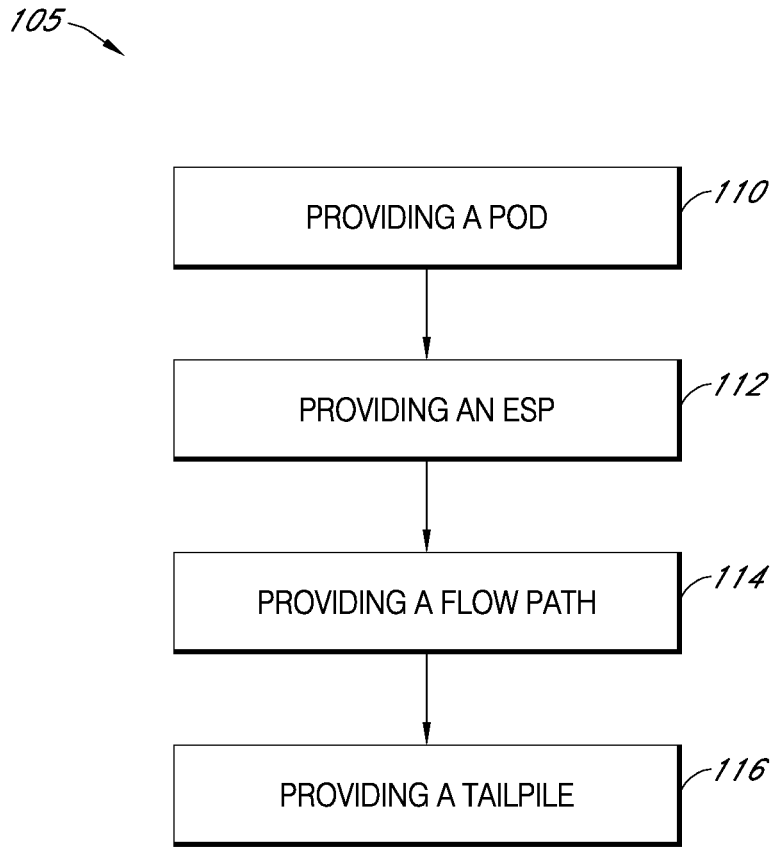

With specific reference to FIG. 4, an exemplary flow chart depicting a method of operation or use is shown. Particularly, at a block 110 a pod is provided. An additional step includes providing an ESP at a block 112. Likewise, a flow path is provided at block 114. And another step of providing a tailpipe is provided at a block 116. Specific details of the above described method of operation are provided in more detail below.

A system for injecting fluids from a source zone to a downhole target zone associated with a well, comprising a pod having a pod casing that defines an interior space. Additionally, the system includes an electric submersible pump supported within the pod casing interior space and having an inlet. Further, the system includes a flow path for conveying fluid from the source zone to the electric submersible pump inlet. Also, the system includes a tailpipe having one or more tubing sections extending in a downhole direction and being cooperatively associated with the pod such that the weight of the tailpipe is substantially supported by the pod.

In certain configurations, this system further provides that the electric submersible pump is a bottom discharge electric submersible pump.

In certain configurations, this system further provides that the pod includes a pod hanger for supporting the pod casing and wherein the electric submersible pump is supported on a supporting tube supported by the pod hanger.

In certain configurations, this system further provides that the flow path is defined at least in part by at least one perforation in the pod casing to allow fluid flow of the injection fluid from the exterior of the pod to the interior space of the pod.

In certain configurations, this system further provides that the electric submersible pump includes a discharge tube, and wherein the pod includes a pod lower end having a seal bore formed therein, the discharge tube being adapted to fit within the seal bore.

In certain configurations, this system further provides that the discharge tube cooperates with a seal assembly for engaging the seal bore.

In certain configurations, this system further provides that the discharge tube cooperates with a packer for engaging the seal bore.

In certain configurations, this system further provides that the an upper tube extending downward from the source zone. Additionally, this system further provides a pod hanger for supporting the pod casing, the upper tube supporting the pod hanger and a supporting tube extending downward from the pod hanger and supporting the electric submersible pump within the pod interior space. Further, the flow path is at least partially formed by a perforated tubing joint in the upper tube and a perforated tubing joint in the supporting tube.

In certain configurations, this system further provides an upper tube extending downward from the source zone and a pod hanger for supporting the pod casing, the upper tube supporting the pod hanger. Also included is a supporting tube extending downward from the pod hanger and supporting the electric submersible pump within the pod interior space. Additionally, the flow path is at least partially formed by a sliding sleeve cooperating with the upper tube and sliding sleeve in the supporting tube.

In certain configurations, this system further provides that the tailpipe interfaces with an isolation device set in the well above the target zone for fluid injection.

In certain configurations, this system further provides that the isolation device comprises a packer.

A pod structure for containing a bottom discharge electric submersible pump in oil well applications comprising a pod casing defining an interior space for receiving the electric submersible pump. Also included is a pod hanger cooperating with the pod casing to provide support thereto. Additionally, included is a pod lower end defining a seal bore for receiving a discharge tube of the electric submersible pump.

In certain configurations, this structure further provides that the pod casing is provided with at least one perforation for permitting flow of fluid from outside the pod to the pod interior space.

In certain configurations, this structure further provides a tailpipe interface for engaging a tailpipe disposed at the pod lower end.

A method for injecting fluids from a source zone to a downhole target zone associated with a well, comprising providing a pod having a pod casing that defines an interior space. Also included in this method is providing an electric submersible pump supported within the pod casing interior space and having an inlet. Further method steps include providing a flow path for conveying fluid from the source zone to the electric submersible pump inlet and providing a tailpipe having one or more tubing sections extending in a downhole direction and being cooperatively associated with the pod such that the weight of the tailpipe is substantially supported by the pod.

In certain configurations, this method further provides that the electric submersible pump is a bottom discharge electric submersible pump.

In certain configurations, this method further provides that pod includes a pod hanger for supporting the pod casing and wherein the electric submersible pump is supported on a supporting tube supported by the pod hanger.

In certain configurations, this method further provides that the flow path is defined at least in part by at least one perforation in the pod casing to allow fluid flow of the injection fluid from the exterior of the pod to the interior space of the pod.

Although several embodiments of exemplary systems according to aspects of the invention have been illustrated and described, many variations in components and designs may be employed for a given application and/or environment. For example, a variety of pod configurations may be incorporated into the system. In some embodiments, reinforced structures on the pod may be provided to enhance the load-bearing capabilities thereof. For further example, other implements for connecting downhole components, such as the tailpipe tubing, to the pod may be employed. Other components also may be adjusted or interchanged to accommodate specifics of a given application. For example, the pod casing may take other forms that provide support to the downhole components and that isolate the ESP from the weight of the same. It will be recognized that the flow configurations of FIGS. 1-4 are not exclusive of one another and could be used in combination.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for injecting fluids, comprising:

a pod having a pod casing that defines an interior space;

an electric submersible pump supported within the pod casing interior space, the electric submersible pump having a discharge tube through which fluid is discharged when the electric submersible pump is operated, a seal assembly being coupled to the discharge tube for sealing engagement with the pod, the electric submersible pump being oriented to enable pumping of fluid along a flow path extending from a source zone located above the electric submersible pump to a target zone located below the electric submersible pump, the electric submersible pump comprising an inlet positioned to receive fluid flowing from the source zone; and a tailpipe having one or more tubing sections extending in a downhole direction and being cooperatively associated with the pod such that the weight of the tailpipe is substantially supported by the pod, wherein the pod includes a pod lower end having a seal bore formed therein to receive the seal assembly, wherein the tailpipe extends through a packer.

2. The system of claim 1, wherein the electric submersible pump is a bottom discharge electric submersible pump.

3. The system of claim 1, wherein the pod includes a pod hanger for supporting the pod casing and wherein the electric submersible pump is supported on a supporting tube supported by the pod hanger.

4. The system of claim 1, wherein the flow path is defined at least in part by at least one perforation in the pod casing to allow fluid flow from the exterior of the pod to the interior space of the pod.

5. A system for injecting fluids, comprising:

a pod having a pod casing that defines an interior space;

an electric submersible pump supported within the pod casing interior space, the electric submersible pump having a discharge tube through which fluid is discharged when the electric submersible pump is operated, a seal assembly being coupled to the discharge tube for sealing engagement with the pod, the electric submersible pump being oriented to enable pumping of fluid along a flow path extending from a source zone located above the electric submersible pump to a target zone located below the electric submersible pump, the electric submersible pump comprising an inlet positioned to receive fluid flowing from the source zone;

a tailpipe having one or more tubing sections extending in a downhole direction and being cooperatively associated with the pod such that the weight of the tailpipe is substantially supported by the pod;

an upper tube extending downward from the source zone;

a pod hanger for supporting the pod casing, the upper tube supporting the pod hanger;

a supporting tube extending downward from the pod hanger and supporting the electric submersible pump within the pod interior space;

wherein the flow path is at least partially formed by a perforated tubing joint in the upper tube and a perforated tubing joint in the supporting tube.

6. A system for injecting fluids, comprising:

a pod having a pod casing that defines an interior space;

an electric submersible pump supported within the pod casing interior space, the electric submersible pump having a discharge tube through which fluid is discharged when the electric submersible pump is operated, a seal assembly being coupled to the discharge tube for sealing engagement with the pod, the electric submersible pump being oriented to enable pumping of fluid along a flow path extending from a source zone located above the electric submersible pump to a target zone located below the electric submersible pump, the electric submersible pump comprising an inlet positioned to receive fluid flowing from the source zone;

a tailpipe having one or more tubing sections extending in a downhole direction and being cooperatively associated with the pod such that the weight of the tailpipe is substantially supported by the pod;

an upper tube extending downward from the source zone;

a pod hanger for supporting the pod casing, the upper tube supporting the pod hanger;

a supporting tube extending downward from the pod hanger and supporting the electric submersible pump within the pod interior space;

wherein the flow path is at least partially formed by a sliding sleeve cooperating with the upper tube and sliding sleeve in the supporting tube.

7. A system for injecting fluids, comprising:

a pod having a pod casing that defines an interior space;

an electric submersible pump supported within the pod casing interior space, the electric submersible pump having a discharge tube through which fluid is discharged when the electric submersible pump is operated, a seal assembly being coupled to the discharge tube for sealing engagement with the pod, the electric submersible pump being oriented to enable pumping of fluid along a flow path extending from a source zone located above the electric submersible pump to a target zone located below the electric submersible pump, the electric submersible pump comprising an inlet positioned to receive fluid flowing from the source zone; and a tailpipe having one or more tubing sections extending in a downhole direction and being cooperatively associated with the pod such that the weight of the tailpipe is substantially supported by the pod, wherein the tailpipe interfaces with an isolation device set in the well above the target zone for fluid injection.

8. The system of claim 7, wherein the isolation device comprises a packer.

9. The system of claim 7, wherein the pod casing is provided with at least one perforation for permitting flow of fluid from outside the pod to the pod interior space.

* * * * *